United States Patent [19]

Konnemann

[11] 4,149,137

[45] Apr. 10, 1979

[54] FLAT SAFETY FUSE

[75] Inventor: Alfred Konnemann, Wuppertal, Fed. Rep. of Germany

[73] Assignee: Grote & Hartmann GmbH & Co. KG, Wuppertal, Fed. Rep. of Germany

[21] Appl. No.: 807,158

[22] Filed: Jun. 16, 1977

[30] Foreign Application Priority Data

Jul. 8, 1976 [DE] Fed. Rep. of Germany ..... 2630697

[51] Int. Cl.[2] ..... H01H 85/10

[52] U.S. Cl. ..... 337/295; 337/290; 337/293

[58] Field of Search ..... 337/295, 290, 413, 416, 337/401, 217, 296, 297, 292, 293, 159

[56] References Cited

U.S. PATENT DOCUMENTS

| | | | |
|---|---|---|---|
| 307,639 | 11/1884 | Gilliland | 337/297 |
| 949,296 | 2/1910 | Dorff | 337/290 |
| 2,263,752 | 11/1941 | Babler | 337/297 |
| 3,413,586 | 11/1968 | Salzer | 337/295 |
| 4,031,497 | 6/1977 | Ozawa | 337/297 |

*Primary Examiner*—Harold Broome

*Attorney, Agent, or Firm*—Friedman, Goodman & Teitelbaum

[57] ABSTRACT

A flat safety fuse having a carrier plate fabricated from a synthetic material on which is mounted a sheet metal member with at least one fusible arc. The fusible arc has an inner diameter equal to the distance between parallel inner edges of its supporting bases which are each attached to associated contact surfaces separated from each other by a slot. The sheet metal member is received in a recess provided in a surface of the carrier plate. Preferably, the sheet metal member is secured in the recess by pressure arcs and clamping portions provided on the sheet metal member and by raised clamping portions provided on the carrier plate. Preferably, the sheet metal member has a W-shaped configuration to provide two fusible arcs.

15 Claims, 4 Drawing Figures

FLAT SAFETY FUSE

BACKGROUND OF THE INVENTION

The present invention concerns an electrical flat safety fuse, especially for the flow of electricity in motor vehicles. It is evident that this new flat safety fuse can also be used in other types of electrical equipment which need many electrical units, where it can be placed within a limited space, like for example, washing machines, televisions, radios and the like.

Comparable safety fuses are constructed in the form of printed circuits. They are very expensive because of the manufacturing procedures in connection therewith, and also because of the required use of expensive raw materials. Furthermore, and in particular for the flow of electricity in motor vehicles, multiple rod-like ceramic or synthetic material bodies are used, on which is attached a small strip of metal which serves as the melting safety fuse part. This latter type of fuse can be used, however, only as an individual fuse, which requires a considerable amount of space and is relatively heavy.

SUMMARY OF THE INVENTION

The purpose of the present invention is to provide a flat safety fuse which is light weight, occupies but a limited space, can be utilized as a multiple safety fuse and which, in particular with regards to the raw materials and manufacture thereof, does not entail high expenses in connection therewith.

Accordingly, it is an object of the present invention to provide an improved flat safety fuse which solves the aforementioned problems of the prior art devices.

In accordance with the present invention, this is solved through the use of a flat safety fuse which is characterized by a synthetic material carrier plate on which is installed a section of sheet metal having at least one fusible arc. The carrier plate is provided with recess means to receive the sheet metal section, where the sheet metal section is preferably secured in the recess means by pressure arcs and clamping portions. Preferably, each sheet metal section has a W-shaped configuration to define two fusible arcs.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

in the various figures of the drawing like reference characters designate like parts.

DESCRIPTION OF THE PREFERRED EMBODIMENT

Figure 1:
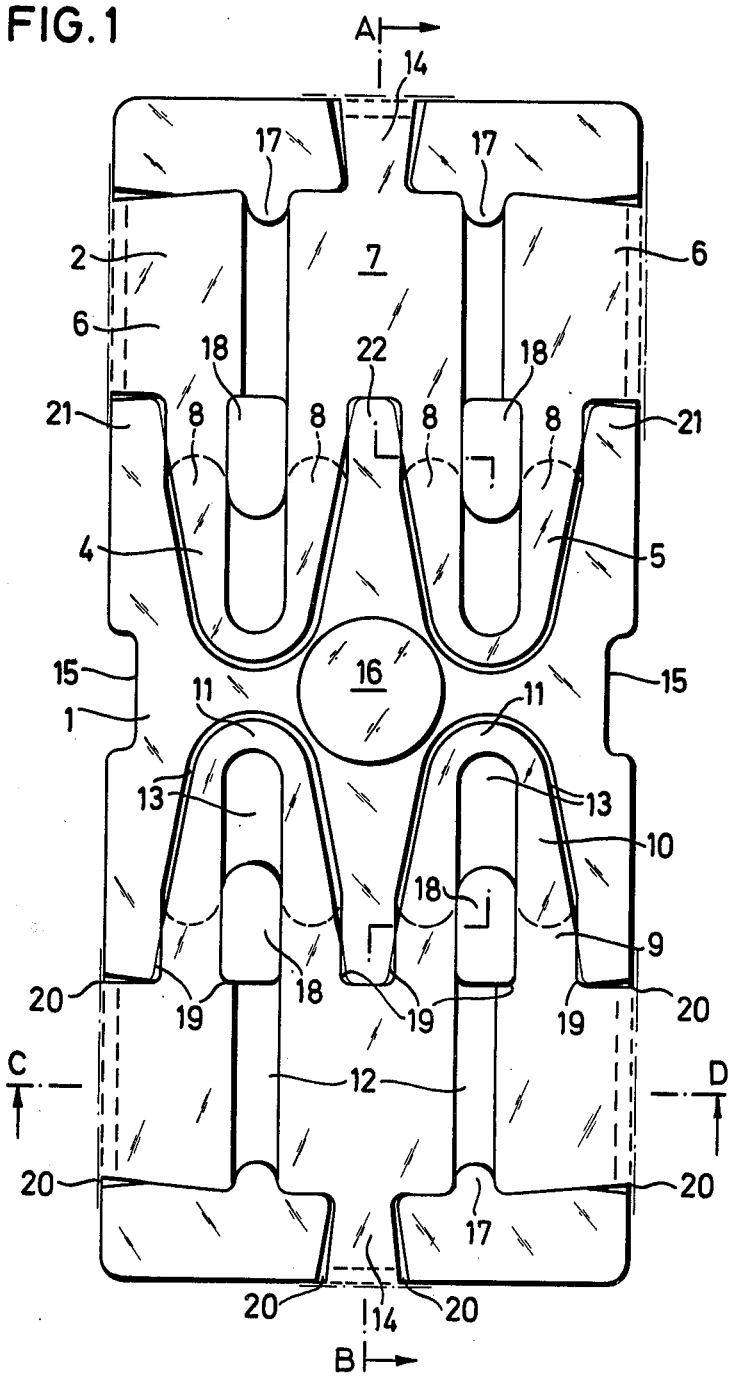
FIG. 1 is a top plan view of a multiple flat safety fuse of the present invention.
Figure 2:
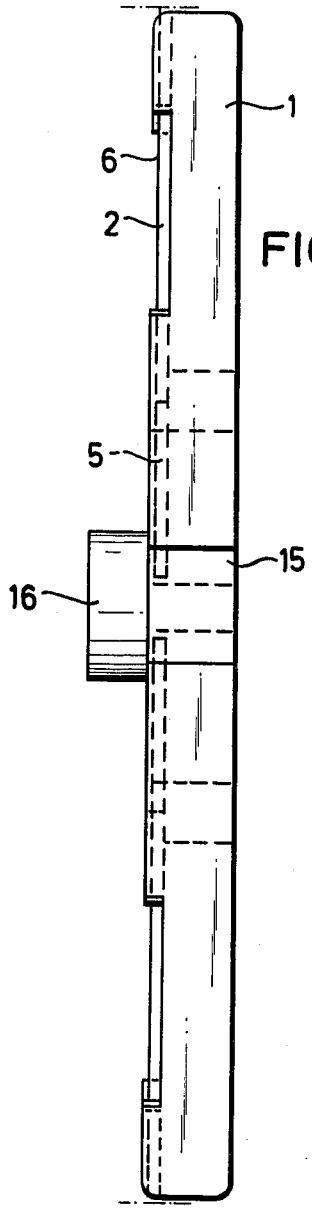
FIG. 2 is a side elevational view of the safety fuse.

The flat safety fuse represented in the drawings shows two sections forming a twin-double fuse with four fusible arcs. Of course, within the context of the present invention, there can also be safety fuses having one, two or more than two fusible arcs mounted on one side and/or both sides of the flat safety fuse. In the strictest sense, the combination possibilities are almost unlimited.

The twin-double fuse includes two metal strips or sections 2 and a carrier plate 1, which is made out of synthetic material or where the synthetic material is sprayed onto the surface of the carrier plate. The synthetic material of or on the carrier plate is heat stable, i.e., it resists the temperatures which are created at the fusion of the safety fuses.

In the top view as shown in FIG. 1, each metal strip 2 is formed of a single unitary piece of substantially constant thickness throughout, and is in essentially a W-shaped configuration. Each section 2 includes two fusible arc sections 4 and 5 extending into a pair of bases 8 for each arc section. Each base 8 of the arcs extends into a contact terminal surface member 6 and 7, where the outer two bases 8 are connected to separate outerly disposed surface members 6 and the inner two bases 8 are connected to the same centrally located surface member 7. Each base 8 of the fusible arc includes a part 9 of uniform width and a wedge-shaped tapering part 10. The taper of each part 10 extends from a wide portion adjacent part 9 to a narrow portion near the arc to provide an oblique outer side, while the inner side thereof continues in a straight alignment with part 9 without modification.

Each pair of tapering parts 10 is connected to one fusible arc zone 11 with a uniform width being provided around the zone 11 from one part 10 to the opposite part 10. The inner diameter of the zone 11 of the fusible arc is equal to the distance between the parallel inner edges of the associated bases 8 for each arc. In turn, this distance corresponds at least, and preferably somewhat larger than the permissible air passage stretch.

The outer radius of the zone 11 of the fusible arc is determined by the required melting mass of the metal. Consequently, the angle of the oblique outer side of part 10 of the base 8 is a function of both these criteria, which one skilled in the art can determine for each case of use depending on the type of metal used. The length of a fusible arc is determined by the resistance of the synthetic material of the carrier plate to the heat, which at the fusion of the fusible arc area 11 occurs on part 9 of the base 8.

The contact surface member 6 is separated from the contact surface member 7 by means of a slot 12, which is at least and preferably equal to the permissible air passage stretch. The sheet metal part 2 further includes a conical or tapered cover plate 14, which is used in the manufacture of the sheet bar and also for the connection and binding means of the sheet bar onto the synthetic material carrier plate 1.

Figure 3:
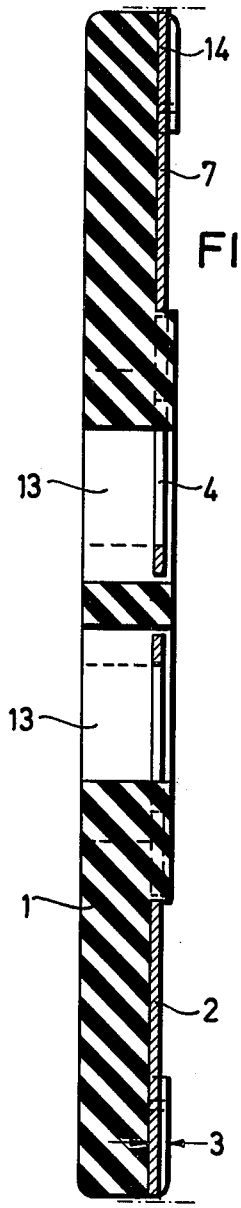
FIG. 3 is a cross-sectional view taken along line A–B of FIG. 1.
Figure 4:
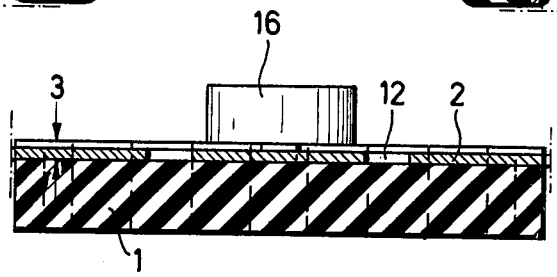
FIG. 4 is a cross-sectional view taken along line C–D of FIG. 1.

The carrier plate 1 includes on its upper surface the contours of the sheet metal parts 2 in the form of a pair of recesses 3, which preferably are injection molded therein. The recesses 3 preferably are slightly deeper than the thickness of the sheet metal part 2, as best shown in FIGS. 3 and 4. Furthermore, in the area of each of the fusible arcs 4 and 5, an air pocket 13 is provided which has the form and the size of its associated fusible arc and serves for heat and electrical isolation. Each air pocket 13, however, is formed in a V-like shaped configuration and extends from slightly above the arc zone 11 to about the junction of part 10 and part 9 on the base 8. Furthermore, the carrier plate 1 possesses opposing recesses 15 to receive a spring bolt (not shown) for the carrier body and a mounting button 16, which facilitates the holding thereof during the manufacture of the safety fuse and also for holding the safety fuse in the appropriate installation during use.

Essentially it is the raised portions or tabs 17 which are engaged in the slots 12 and provide that the contact surface members 6 and 7 are fixed a proper distance apart for the air passage stretch. The raised portions or bosses 18 cooperate with the tabs 17 to position the contact surface members 6 and 7, and also maintain the distance between the associated bases 8 on each fusible arc 4 or 5 which are engaged on opposite sides of each boss 18. The widths of the tabs 17 and bosses 18 correspond in each case to the desired air passage stretches.

The sheet metal parts 2 can be permanently secured, such as by glue, cement and like adhesive material, onto the carrier plate 1, where a suitable heat resisting adhesive material is required to be used. However, in a preferred form of the present invention, each sheet metal part is removably secured and maintained by means of pressure arcs 19 and clamping means 20 coacting between the sheet metal parts 2 and the carrier plate 1. These fixations occur when pressing the sheet metal parts 2 onto the carrier plate 1. The quantity of material on each sheet metal part 2 at the portions which serve for the above mentioned fixation, is chose slightly higher or more than for the remaining skeleton form which fits precisely into each recess 3 of the carrier plate 1. Because of this feature, after the pressing in thereof, there exists a clamping saddle which, when executed in accordance with the present invention, offers an exceptional retention and which is essentially exceptionally easy to manufacture.

It is surprising that only a few fixations at positions 19 and 20 are sufficient to guarantee a fixed position to the sheet metal part. Furthermore, there is the advantage that the opposing sides of the clamping means 20 in the area of the contact surface member 6 run conically or taper towards each other in a direction towards the free outer edge, while in the area of the cover plate 14 the opposing sides run conically or taper away from each other in a direction towards the free outer edge. Furthermore, it is essential that for the manufacture of the pressure arcs 19, the radius in the sheet metal part 2 is chosen greater than the corresponding cooperating radius of the carrier plate 1. The bosses 18 work in this arrangement together with the additional raised portions or ribs 21 and 22 as clamping means cooperating with the pressure arcs 19.

The flat safety fuse in accordance with this invention provides a very light type of construction. Its manufacture is uncomplicated and the space it occupies is extremely reduced from that of the prior art. It is possible to manufacture safety fuse plates with multiple fuses which, when executed on both sides as shown in the drawing, permit after the use of one side, the use of the other after an 180° turn. Through the optimization of the isolation stretches, specifically the areas of the carrier plate and of the fusible arc areas, a very effective and adequately functioning flat safety fuse is obtained, which exceeds all known safety fuses of this type especially with regards to the quantity of flow of electricity.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A flat safety fuse particularly for flow of electricity in a motor vehicle, said fuse comprising a carrier plate having an outer surface of synthetic material, at least one flat sheet metal plate formed of a single unitary piece of substantially constant thickness disposed on said outer surface of said carrier plate, said flat sheet metal plate including at least one fusible arc section, said fusible arc section further including two spaced apart bases at opposite ends thereof, and at least two surface contact terminal sections formed from said flat sheet metal plate, each of said contact terminal sections being continuous from an associated one of said bases, and securing means coupled between said carrier plate and said flat sheet metal plate for holding said flat sheet metal plate on said outer surface of said carrier plate.

2. A flat safety fuse as claimed in claim 1, wherein each base includes first and second parts, said first part being attached to one of said contact terminal sections and having a uniform width, said second part being attached to said first part and having a conically tapering outer edge extending from a wider portion adjacent to said first part to provide an oblique outer edge, an inner edge of said second part being in straight alignment with an inner edge of said first part.

3. A flat safety fuse as claimed in claim 2, wherein a fusible arc zone is connected between an associated pair of said second tapering parts, said arc zone having a uniform width from one of said second parts to the other of said pair of second parts.

4. A flat safety fuse as claimed in claim 3, wherein an inner diameter of said arc zone is equal to distance between parallel inner edges of said first parts and said second parts respectively.

5. A flat safety fuse as claimed in claim 1, wherein said two contact terminal sections are separated from each other by a slot.

6. A flat safety fuse as claimed in claim 1, wherein said carrier plate includes assembly knob means for mounting said safety fuse.

7. A flat safety fuse as claimed in claim 1, wherein said outer surface of said carrier plate includes raised portions for positioning said fusible arc.

8. A flat safety fuse as claimed in claim 1, wherein said securing means includes raised clamping ribs on said outer surface of said carrier plate.

9. A flat safety fuse as claimed in claim 1, wherein said flat sheet metal plate has a W-shaped configuration to provide two spaced apart fusible arcs on one side of said carrier plate.

10. A flat safety fuse particularly for flow of electricity in a motor vehicle, said fuse comprising a carrier plate having an outer surface of synthetic material, a flat sheet metal section disposed on said outer surface of said carrier plate, said flat sheet metal section including at least one fusible arc, and securing means coupled between said flat sheet metal section and said carrier plate for holding said flat sheet metal section on said outer surface of said carrier plate, and wherein said outer surface of said carrier plate includes recess means for receiving said flat sheet metal section, said recess means being deeper than a maximum thickness of said sheet metal section.

11. A flat safety fuse as claimed in claim 10, wherein said securing means includes a conical shaped cover plate disposed on said flat sheet metal section.

12. A flat safety fuse as claimed in claim 10, wherein said carrier plate includes air space means adjacent to said fusible arc, said air space means having a shape and size similar to said fusible arc.

13. A flat safety fuse particularly for flow of electricity in a motor vehicle, said fuse comprising a carrier plate having an outer surface of synthetic material, a flat sheet metal section disposed on said outer surface of said carrier plate, said flat metal section including at least one fusible arc, and securing means coupled between said flat sheet metal section and said carrier plate for holding said flat sheet metal section on said outer surface of said carrier plate, and wherein said securing means includes pressure arcs and clamping means coacting between said sheet metal section and said carrier plate.

14. A flat safety fuse as claimed in claim 13, wherein said pressure arcs and clamping means include a larger quantity of metal material on said sheet metal section than the remaining parts of said sheet metal section.

15. A flat safety fuse as claimed in claim 13, wherein said clamping means are disposed on opposite edges of a contact surface member of said sheet metal section with said opposite edges conically tapering towards each other in a direction toward a free edge of said contact surface member, and a conical shaped cover plate having opposing edges tapering away from each other in a direction toward a free edge thereof.

* * * * *